US005766051A

United States Patent [19]

Messer

[11] Patent Number: 5,766,051

[45] Date of Patent: Jun. 16, 1998

[54] WAKEBOARD TRACTION PAD

[76] Inventor: Jason Messer, Post Office Box 5411, Portland, Oreg. 97228

[21] Appl. No.: 777,259

[22] Filed: Dec. 31, 1996

[51] Int. Cl.[6] ..... B63B 1/00

[52] U.S. Cl. ..... 441/65; 441/68; 441/74

[58] Field of Search ..... 441/65, 74, 75, 441/76, 77, 79, 68, 70

[56] References Cited

U.S. PATENT DOCUMENTS

| | | | |
|---|---|---|---|
| 3,999,224 | 12/1976 | Kollsman | 4/185 |
| 4,902,256 | 2/1990 | Berglund | 441/74 |
| 5,257,953 | 11/1993 | Gillis | 441/74 |
| 5,308,271 | 5/1994 | Foulke | 441/74 |
| 5,433,636 | 7/1995 | Gillis | 441/74 |
| 5,435,765 | 7/1995 | Fletcher | 441/71 |
| 5,460,558 | 10/1995 | Woodstock | 441/74 |
| 5,512,000 | 4/1996 | Robles | 441/70 |

OTHER PUBLICATIONS

Identifying pages and relevant advertisement from "Launch Wakeboard" Magazine, #1.1; pp. cover, 11, and 17.

Article from Oct. 1996 "Sports Trend, " pp. 1, 22, and 24.

*Primary Examiner*—Stephen Avila

*Attorney, Agent, or Firm*—Cislo & Thomas

[57] ABSTRACT

A wakeboard traction pad for a wakeboard providing greater traction and a variable traction-surface geometry for more technical wakeboard riding and increased fun. The wakeboard traction pad is provided to give a high-friction, high-surface area surface upon which a wakeboard rider's feet may constructively engage and control the attached wakeboard. Often used in pairs at opposite sides of the wakeboard, the wakeboard traction pad of the present invention may also be used alone in conjunction with a single binding oppositely opposed to it on the wakeboard. The wakeboard traction pad has a gently tapering foot bed area, a more significantly sloped kicktail, and a center arch support that helps to define two concave depressions between the sides of the wakeboard traction pad for engagement by the heel and/or ball of the foot. By providing a variable geometry, the wakeboard traction pad provides more contact surface area. By generally accommodating the geometry of the sole of the rider's foot, more contact surface is established between the traction pad and the rider for greater control and fun. The wakeboard is made of waterproof, lightweight, soft, and slightly compressible materials to better enhance the traction pad's engagement with the rider for greater traction. A cushiony, but rough, surface is generally provided on all contact areas with the rider for greater traction. The wakeboard may be mounted by attachment means such as bolts or screws or integrally incorporated into the wakeboard.

22 Claims, 1 Drawing Sheet

WAKEBOARD TRACTION PAD

BACKGROUND OF THE INVENTION

1. Field of the Invention

This invention relates to wakeboards, and more particularly to a traction pad that provides more secure footing for attachment and use in conjunction with wakeboards.

2. Description of the Related Art

Wakeboarding is a sport of recent development that combines elements of surfing, skateboarding, and snowboarding. Boards of approximately four feet in length are constructed to provide a platform upon which the rider, or floater, may stand. When pulled by a boat dragging a ski rope or the like, the wakeboarder can use the wake generated by the boat as a ramp or an incline upon which to perform tricks and stunts. Additionally, much enjoyment is derived by skimming over the water using the wakeboard.

While some wakeboards may have a single end or a preferred direction of travel (similar in manner as to a surfboard), such single end designs in wakeboards are restricted in that they generally have only one direction of travel. This is sometimes a disadvantage as it is possible to twist and turn while wakeboarding so that either end may be acting as the front of the wakeboard. The front of the wakeboard is generally considered that end which precedes the rider in the direction of travel. Sometimes this is one of either of the two ends of the wakeboard, other times it is one of the two sides. Therefore, it is generally preferable to have a symmetrical wakeboard that allows the rider to skim and ride the water in any available direction. For this reason, some wakeboards have small fixed rudders at one or both ends in order to provide directional control means for the travel of the wakeboard. By providing a wakeboard that allows the rider to skim the water no matter what the front end is, the rider does not need to be concerned about disposing the wakeboard in any particular position in order to have great enjoyment and fun wakeboarding over the water.

As mentioned above, the rider of the wakeboard is pulled along much in the same manner as a person who is water skiing. A tow rope or the like is attached to a boat and has a handle at its end with the tow rope dragged behind the boat. The wakeboarder may grab the line at its handle and skim along the water surface on top of the wakeboard following the boat.

One enhancement present in wakeboarding is the fact that the wake of the boat pulling the rider serves to provide a ramp or the like over which the wakeboarder can ride or jump. It is not uncommon for experienced wakeboarders to use the wake of the boat to launch themselves into the air. For more advanced wakeboarders, it becomes relatively easy to turn a somersault in the air landing back upon the wakeboard ready to engage in or perform another stunt or trick. Additionally, should the boat turn a circle so that it might cross its own wake, additional ramps and jumps may be provided by the water to allow even greater challenges to the wakeboarder.

Wakeboarding can be considered as similar to snowboarding and parallels exist between the two. Just as snowboarding has a corollary with snow or alpine skiing, so wakeboarding also has a corollary in water skiing. Both snowboarding and wakeboarding involve the use of a single board which is used to skim over a low friction surface, water and snow, respectively.

In the past, bindings have always been used with wakeboards in much the same way that bindings are used for snowboards. For snowboarding, it is extremely important that there be means by which the snowboard can be removably attached to the snowboarder so that the snowboard does not proceed to fly down the hill should the snowboarder fall or drop from the snowboard. It was previously believed that bindings were also required for wakeboards.

Bindings are basically flexible rubber boots that allow the wakeboarder to attach him or herself to the wakeboard. Brackets or the like are attached to the wakeboard itself while the flexible rubber boot is attached to the brackets.

While the similarity to snowboarding prompted the use of bindings in wakeboarding, differences in the sporting environment for both snowboarding and wakeboarding has and may lead to problems specific to the individual sports. In snowboarding, breathable air is generally always available and there is generally no need to detach oneself quickly from the snowboard as it is possible to maintain some control over the board, even if merely by sitting down in order to stop downhill progress. Additionally, as mentioned above, in order to prevent runaway boards from shooting down the slope at a high rate of speed and potentially injuring somebody very seriously, the bindings serve to attach the board to the snowboarder so that it is safely used on the ski slopes.

Additionally, it may have been very easy for makers and manufacturers of snowboard bindings to adapt such bindings to wakeboards. The contours of the feet would almost be the same for both wakeboards and snowboards. Once the accommodation for bare feet or the like is made, bindings used for snowboards might easily be transferred to wakeboards.

However, such wakeboard bindings force the person to be mechanically attached to the wakeboard for the duration of the ride. If necessary to quickly release or disengage the wakeboard, this can become very difficult even though emergency releases or other quick release mechanisms may be provided by the bindings. Additionally, bindings force the wakeboarder to assume a particular stance, posture, or disposition with respect to the wakeboard as the feet are physically attached to the wakeboard and cannot be moved.

Furthermore, injuries may arise through the direct attachment of the wakeboard to the rider. Particularly, injuries to the ankles, knees, and hips are prevalent and these leg joints all may suffer extreme stresses and forces during misexecuted maneuvers or the like which may uncontrollably twist or torque the rider and his lower extremities when he or she hits the water. Bindings also decrease the skill and finesse a wakeboarder must use in order to maneuver the board as the direct physical attachment of the wakeboard to the rider's feet allows the wakeboarder to use the direct attachment to directly control the disposition of the board. The nimble placement of one's weight upon the wakeboard is then replaced by using the bindings for control.

Generally, wakeboards cannot be ridden without some means by which the rider's feet can grippingly engage the wakeboard. It is generally unknown to have a wakeboard that is a flat piece of fiberglass without some means by which to engage the board with the feet.

As can be seen from the foregoing, there is need in the wakeboard art to provide means by which wakeboards can be constructively ridden without the use of bindings. Fewer injuries would result from wipe-outs, crashes, and the like. Additionally, more demands upon the rider's balance and finesse would be made thereby delivering more fun and enjoyment to the rider by an increased demand in the skill level needed to make successful rides. Beginners may also benefit as the bindings attaching the wakeboard to the rider may serve as a detrimental burden due to the unfamiliarity of such novice riders with the sport.

SUMMARY OF THE INVENTION

The present invention is set forth in the form of a wakeboard traction pad that provides a bindingless means by which a wakeboard rider can constructively and advantageously engage the top surface of the wakeboard in order to provide for a fun and controlled wakeboard ride.

While commonly used in pairs, the wakeboard traction pad of the present invention may also be used in conjunction with a single binding that would attach one foot of the wakeboard rider to the wakeboard. The wakeboard traction pad is approximately the size of a human foot in square area. This is generally under the common width normally found for wakeboards so that a pair of traction pads is easily disposed atop the wakeboard. The wakeboard traction pad has a higher, thick or fat front end, or nose, which is generally situated outer most to the rider's central position. The wakeboard traction pad slants downwardly in a tapered fashion towards the innermost or rear portion of the traction pad so that the wakeboard rider's foot finds an increasingly sloped surface the farther out the foot travels from the center of the wakeboard. This provides means by which the wakeboard rider can constructively engage the traction pad and to a certain extent "wedge" him or herself onto the wakeboard (between the traction pads) while avoiding the constricting attachment of bindings.

In order to enhance the available contact surface area between the wakeboard traction pad of the present invention and the wakeboard rider's foot, a central arch support is provided that delivers a central ridge generally traveling the length of the wakeboard traction pad. The central arch support ridge is generally horizontal in angle with the remaining tapering portions on either side of the arch support ridge providing for greater pronouncement of the arch support ridge as it travels towards the inner rear portion of the wakeboard traction pad.

The lower, rear, inner end of the wakeboard traction pad is tapered at its foot in a convex manner to provide a central middle projection that may serve to engage the bottom of the foot, particularly near the arch of the user. In fact, the shape of the wakeboard traction pad serves to provide greater contact surface area between the traction pad and the rider's foot so as to provide greater control and sure footedness.

In order to increase the traction between the traction pad and the rider's foot, grooves are etched laterally across the top of the wakeboard traction pad in a widthwise manner. This provides means by which water can drain from the traction pad and compression and grip may be achieved by the foot upon the traction pad.

By providing a traction pad along the lines of the present invention, a new and different wakeboarding experience with a decreased risk of injury is created demanding of the rider more skill and finesse while delivering increased fun and enjoyment.

OBJECTS OF THE INVENTION

It is an object of the present invention to provide means by which a wakeboard rider can engage the underlying wakeboard without requiring bindings.

It is an additional object of the present invention to provide means by which a wakeboard can be ridden with a decreased risk of injury.

It is yet another object of the present invention to provide a traction pad for a wakeboard that serves to provide high-friction means by which the rider's foot may engage the wakeboard.

It is yet another object of the present invention to provide a high-friction surface for a wakeboard that is comfortable and easy to use.

It is an additional object of the present invention to provide a wakeboard traction pad that provides a variety of angles and surface planes so that a more optimal engagement by the rider with the wakeboard can be achieved.

It is an additional object of the present invention to maximize the contact surface area between a wakeboard traction pad the rider's foot.

These and other object and advantages of the present invention will be apparent from a review of the following specification and accompanying drawings.

DESCRIPTION OF THE PREFERRED EMBODIMENTS

The present invention resides a wakeboard traction pad for use in conjunction with a wakeboard to provide bindingless means by which a wakeboard rider can sure footedly engage the wakeboard.

Figure 1:
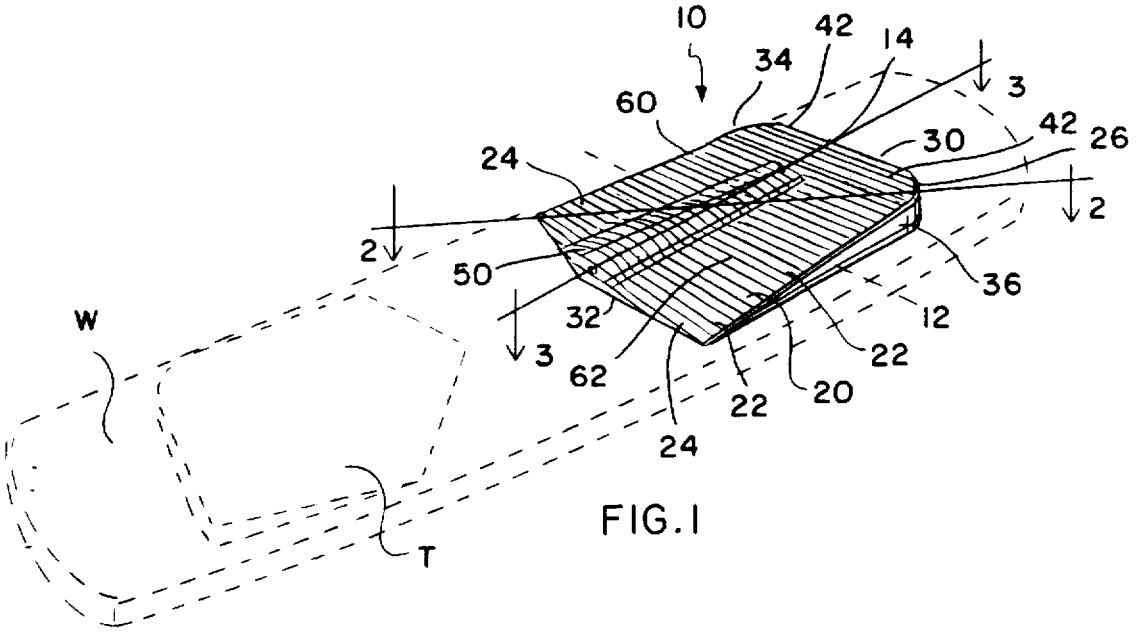
FIG. 1 shows a top, rear prospective view of the wakeboard traction pad of the present invention. An accompanying wakeboard and corresponding traction pad are shown in phantom.

As shown in FIG. 1, the wakeboard traction pad 10 is often used in opposing pairs at opposite ends of a wakeboard W. In order to better understand the functioning of the traction pad 10, a brief description of wakeboards is given below.

Wakeboards are elongated boards resembling wide slats that are used to ride or surf on the water in the wake of a tow boat. Wakeboards are made of lightweight and waterproof materials in order to provide better control through less effort as well as to prevent absorption of water by the board, thereby making it heavier or thereby damaging the board. Material for use and construction of wakeboards are well known in the art and are used throughout the water sport and marine industries. At its most basic level, the wakeboard W could be a four foot by one foot by one inch beveled piece of wood coated with fiberglass resin.

The coatings used to seal the wakeboard W are often slick or flat in nature (enabling low-friction engagement with the water), thereby preventing any sure footing. When water is present (as it must be in the aqueous environment), the surface of the wakeboard becomes slick and it becomes difficult to maintain ones footing on the wakeboard. Therefore, the use of bindings or the like to attach the foot or feet to the wakeboard is currently the prevalent means by which to keep the wakeboard associated with the rider. As set forth above, there are certain disadvantages to bindings, not the least of which is the possibility of injury due to the twisting and torquing that the wakeboard can inflict upon the rider when he or she loses balance and falls into the water.

The wakeboard traction pad 10 of the present invention serves to provide a high-friction and high-surface-area contact pad that also resiliently deforms to the foot pressure applied by the rider. By providing a high-friction contact pad, the rider's feet do not slip with respect to the wakeboard. By providing a high-surface-area contact pad, the rider is more able to securely engage the wakeboard W. By providing resilient deformation of the traction pad 10 by the rider's weight, a cushioned and more comfortable step is provided which also increases the surface area contact between the traction pad 10 and the rider's foot. Additional features, advantages, and the operation of the traction pad 10 of the present invention are discusses in more detail below.

As shown in FIG. 1, the wakeboard traction pad 10 spans approximately the width of the wakeboard W. Generally, a margin of the wakeboard is left between the traction pad 10 and the wakeboard W as certain maneuvers, tricks, and stunts include the gripping of the board adjacent to the traction pad 10 by the hand. It is considered bad form merely to slap the board or to engage it without gripping it as such actions show a loss of control. The margin between the traction pad 10 and the side of the wakeboard W provides room for gripping.

The traction pad 10 is placed at one end of the wakeboard W to provide balanced footing for the rider. As shown in FIG. 1, a second wakeboard traction pad T may be placed opposite the first wakeboard traction pad 10 on the wakeboard W. This allows the rider to balance him or herself on the wakeboard by placing of the feet on either side of the wakeboard's center of gravity. It also provides a wide area of high-friction contact with the wakeboard so as to enable changing one's balance on, and therefore the control over, the wakeboard W.

In one embodiment, the wakeboard traction pad 10 of the present invention may approximately be ten and one-half inches (10½") wide at first width mid-line 12. The traction pad 10 may also be approximately eleven and one-half inches (11½") at a length mid-line 14. Due to the tapered, ridged, and concave geometry all present in the present wakeboard traction pad 10, such measurements are general in nature and reflect generally the proportions that are contemplated for use in conjunction with the wakeboard traction pad 10 of the present invention. Of course, such traction pads 10 may be resized to fit larger adult feet or smaller children's feet according to the end result of optimizing the sure footedness the wakeboard rider achieves by use of the traction pads 10. However, the dimensions set forth above are believed to provide a single size of the traction pad 10 which may fit most, if not all, persons.

In FIG. 1, the top surface 20 of the traction pad 10 is scored with a number of parallel widthwise grooves 22. Such widthwise grooves 22 serve to channel water (which can act as a slippery lubricant) away from the underside of the rider's foot. Much to the same extent that automobile tires may hydroplane on wet surfaces, it might be possible that even if the wakeboard rider were standing on high-friction sandpaper that his foot might slip due to a wet water layer of water between his foot and the sandpaper. The widthwise grooves serve to allow egress of the water away from the top traction pad surface 20 and from under the board rider's foot, thereby increasing the traction delivered by the traction pad 10 to the rider.

In between each of the grooves 22, and on all other exposed top surfaces, a soft but roughened surface 24 is present in order to provide better engagement of the rider's foot by the traction pad 10 due to increased friction. Such rough surfaces are generally easily obtained through manufacturing processes with lightweight and waterproof materials as are known in the art. The top edge of 26 circumscribing the top surface 20 may be beveled slightly to provide a more cosmetically attractive traction pad and to provide a dull corner about which the rider can curl the toes in order to better grip the edge of the traction pad 10 with them.

The high end or edge 30 of the wakeboard traction pad 10 of the present invention is generally situated closer to the end of the wakeboard W and is denoted generally by the term nose, front end, or high end 30. The end of the traction pad 10 opposite the high front end 30 is the lower back end 32. Left and right sides 34, 36 can be determined from looking from the lower rear or back end 32 to the high front end 30. These definitions are generally important as the following description of the traction pad 10 geometry is an important feature adding enhanced utility and advantage to the traction pad 10 as it provides greater sure s footedness for the wakeboard rider.

The high front end 30 of the traction pad 10 may be approximately one and one half inches (1½") tall from its base 40 to the top surface 20. This is in contrast to the height of the lower back end 32 which is slightly over one fourth inch (¼"). From these measurements and from FIGS. 1 through 3, it can be seen that there is a changing geometry present along the top surface 20 of the wakeboard traction pad 10. The base 40 is generally flat to provide a large surface area by which the underside of the traction pad 10 may engage the wakeboard W.

In the preferred embodiment, the taper that is present between the high front end 30 and lower back end 32 of the top surface 20 is not uniform in that it is not like a straight ramp. Instead, the slope that is present from the lower back end 32 to the high front end 30 is initially gradual as travel is made from the lower back end 32 to the high front end 30. The gradual taper proceeds for approximately three-fourths (¾) of the length of the traction pad 10. For example, the height of the traction pad three fourths (¾) the distance from the lower back end 32 may be approximately nine-tenths inch (9/10"). This gradual sloping for the initial portion of the traction pad 10 gives way suddenly to a dramatically increased slope that mediates the remaining six to seven-tenths inch (6 to 7/10") in the last quarter or fifth of the traction pad.

This sudden increase in slope of the top surface 20 near the high front end 30 provides a tail that increasingly restricts any lateral movement of the rider's foot towards the high front end 30 along the top surface 20. Additionally, if the rider's foot should slip, generally it would be outwardly along the outside of the foot and away from the center of the wakeboard W. The tail 42 serves to inhibit such movement near the high front end 30.

Additionally, increased leverage or torque may be applied to the center of mass of the wakeboard W by moving the foot increasingly towards the high front end 30. The tail 42 provides additional means by which more leverage can be obtained over the motion and travel of the wakeboard by the distribution of weight, force, and sudden shifts of weight or step-pulses (such as when weight is suddenly applied to the foot by the rider to the wakeboard). This is true for both front and rear traction pads 10. Both the leading and trailing ends or edges of the wakeboard W may be controlled in a similar manner by each corresponding traction pad 10. By providing such advantageous leverage and mechanical advantage over the wakeboard W, the traction pad 10 of the present invention delivers a unique mechanism by which the sport of wakeboard riding can advance to provide more fun, control, and safety. Without the critical features present in the traction pad 10 and incorporated into its geometry, less advantage would be provided to the wakeboard rider.

A slight outward taper is present at both the left and right sides 34, 36. This tends to increase the width of the wakeboard traction pad from approximately nine and one-half inches (9½") to approximately eleven and one fourth inches (11¼") in one embodiment as travel is made from the high front end 30 to the lower back end 32.

Along the center length of the traction pad 10, an arch support 50 serves to better engage the underside of the rider's foot. In one embodiment, the arch support 50 takes the form of an upraised ridge or crest that travels from adjacent the start of the kicktail 42 to the middle of the lower back end 32. The arch support 50 generally maintains its elevation from the base 40 of the traction pad 10 throughout its length of travel until it reaches the lower back end 32 where it tapers. The taper of the arch support 50 at the lower back end 32 coincides with the gently tapered and pointed lower back end 32 at its center.

On either side of the arch support 50 are two generally concave depressions defined between the arch support 50 and the left and right sides 34, 36. The left concave depression 60 is defined between the left side 34 and arch support 50. The right concave depression 62 is defined between the right side 36 and the arch support 50. The left and right concave depressions 60, 62 as well as the arch support 50, provide a footbed upon which engagement with the traction pad 10 and wakeboard W may be made with the foot at the toes, ball, palm, and heel of the foot. By presenting a general geometry that seeks to negotiate the shape of the sole of the foot, the traction pad 10 of the present invention ensures greater sure footedness for the wakeboard rider.

The left concave depression has its sides tapered upwardly at both the arch support 50 and at the left side 34. This provides a seat into which the ball or heel of the foot may sit with slight lateral upward tapering present on either side of the foot's ball or heel. This provides for greater traction and sure-footedness on the traction pad 10 as the shape of both the ball and heel of the foot have descending and ascending portions which can be accommodated by the left concave depression 60. The resilient and slightly compressible nature of the traction pad 10 also serves to provide greater contact between the foot and the traction pad at the left concave depression 60.

The right concave depression 62 is generally similar to the left concave depression 60 and can generally be considered to be a mirror image of the left concave depression 60 in geometry. The right concave depression 62 is structured and operates in the same manner as the left concave depression 60.

Figure 2:
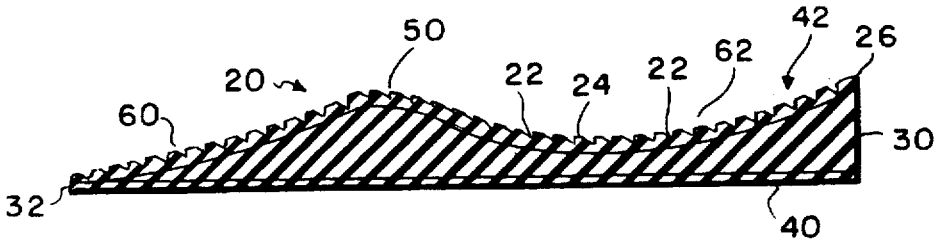
FIG. 2 shows a cross section view of the wakeboard traction pad of FIG. 1 taken along diagonal line 2—2.

As shown in FIG. 2, the traction pad 10 has a variable geometry when viewed along a diagonal from the corner of the high front end 30 and the right side 36 and the corner of the lower back end 32 and left side 34. The kicktail 42 gives way to a portion of the right concave depression 62 before encountering the arch support 50. The arch support 50 is then followed by the left concave depression 60 until reaching the far corner.

FIG. 2 also shows the grooves 22 in between the flat rough surfaces 24.

Figure 3:
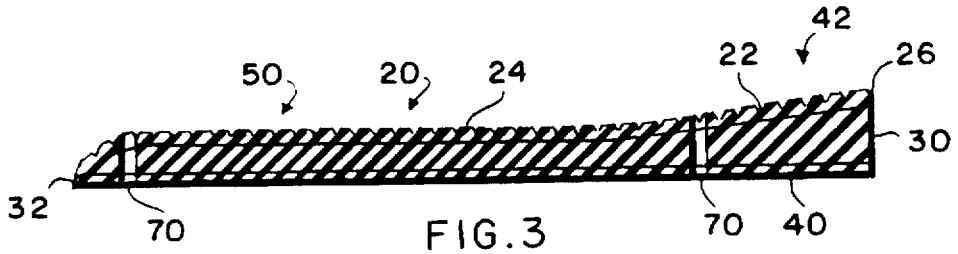
FIG. 3 shows a side cross section view of the wakeboard traction pad of FIG. 1 taken along length line 3—3.

As shown in FIG. 3, the geometry of the arch support 50 is generally straight along its length. The kicktail 42 gives way to the arch support 50. The arch support 50 in turn gives way to the lower back end 32 as it tapers down to the base 40. As shown in FIG. 3, screw or bolt holes 70 are present and serve as means through which attachment means such as screws or bolts may be used to attach the wakeboard traction pad 10 to the wakeboard W. Such screws or bolts should have heads flush with the top surface 20 of the traction pad 10 so as not to interfere with the course of the rider's feet. Similarly, in order to reduce turbulence as the wakeboard W passes through the water, the underside of the wakeboard should be smooth and any attachment means for the traction pad 10 should be flush with the underside of the wakeboard W.

Alternatively, the wakeboard W may be constructed having wakeboard traction pads 10 integrally fitted into the wakeboard W. The screw or bolt holes 70 will then not be needed as an adhesive or the like might be used in a form fitting depression for the traction pad 10 in order to attach the traction pad 10 to the wakeboard W.

Having described the construction and geometry of the wakeboard traction pad of the present invention, its use and operation are achieved as follows.

After fitting a wakeboard W with traction pads 10, the rider may mount the wakeboard behind a towboat pulling a tow rope onto which the rider holds. One or two traction pads 10 may be used on the wakeboard. If only one traction pad 10 is used, often a foot binding is used to attach the other foot to the wakeboard, leaving the other foot free to engage the traction pad.

The rider may start out sitting or crouched upon the wakeboard W until sufficient speed is gained from the towboat and the rider is able to stand up on the wakeboard W. However, it is more common for the rider to start from a standing position atop the wakeboard W. The rider's feet may then engage the wakeboard W via the traction pads 10 and adjustably position his or her stance upon the traction pads for whatever direction, maneuver, or stunt is desired by the rider. The variable geometry of the top surface 20 of the traction pad 10 serves to provide the wakeboard rider with a variety of surfaces upon which to engage the wakeboard W and thereby control it.

The kicktail 42 particularly gives the wakeboard rider leverage and advantage over the wakeboard in order to control its position. When disposed towards the rear of the wakeboard W, the term kicktail describes the slope of the traction pad 10 towards the rear of the wakeboard W. When a traction pad 10 is disposed towards the front of the wakeboard W (as when oppositely paired with a traction pad attached to the rear of the wakeboard W), the slope of the traction pad 10 from the low back end 32 to the high front end 30 can be denominated a "nose kick" in conformance with the sport's nomenclature. The structure of the traction pad 10 is generally, if not exactly, the same when positioned either at the front or rear end of the wakeboard W. In both cases, the kicktail 42 (and the traction pad 10 as a whole) provides greater control over the respective associated end of the wakeboard W.

Freed from bindings, the wakeboard rider is allowed to change position at will to face either direction on the wakeboard W. With bindings, this is not possible as the rider is forced to face one direction with respect to the wakeboard W. Additionally, injuries are reduced as the twisting torques and other forces inflicted upon the rider by the wakeboard when a spill is incurred by the rider are not transmitted to the rider's legs, particularly his or her hips, knees, and ankles.

"Sweet spots" or those positions on the wakeboard where riding is easiest and most fun are easier to find with the traction pad 10 of the present invention. While bindings would lock the associated foot in place, the traction pads 10 allow the rider to find that position on the wakeboard W which best suits him or her. The most comfortable or advantageous riding stance is more easily attained, such a stance possibly unachievable and/or unavailable when bindings are used. When performing or attempting stunts, the traction pads 10 free the rider from the board to allow a wider aerial repertoire of tricks and techniques through wakeboard riding.

While the present invention has been described with regards to particular embodiments, it is recognized that additional variations of the present invention may be devised without departing from the inventive concept. Such additional variations may include the use of the traction pads of the present invention for other water sport boards that involve continuous riding. These sports may include other boards for use in towing behind boats, from a cable, and those boards used in continuous wave or "flow" parks.

What I claim is:

1. A wakeboard traction pad for providing sure-footed engagement of a wakeboard by a rider thereof, comprising:

a top surface for engagement by the rider's feet;

a high front end having a first height and a first width;

a low back end coupled to said high front end, said low back end having a second height and a second width;

said first height being taller than said second height; and said top surface sloping or tapering to mediate said first and second heights; whereby the wakeboard traction pad provides a sloping surface from said high front end to said low back end to provide an angled traction surface and to provide the rider traction upon the wakeboard while riding the wakeboard.

2. The wakeboard traction pad of claim 1, wherein said top surface further comprises:

a roughened surface, said roughened surface providing additional traction to the rider upon the wakeboard.

3. The wakeboard traction pad of claim 2, wherein said top surface further comprises:

water-channelling means for channelling water away from the rider's foot; whereby water from an adjacent aqueous environment may be channelled away from the traction pad to better preserve sure footing for the rider.

4. The wakeboard traction pad of claim 3, wherein said water-channelling means further comprises:

grooves defined by the traction pad widthwise across said top surface; whereby water upon said top surface may drain from said top surface by travelling outwardly from the traction pad.

5. The wakeboard traction pad of claim 1, wherein said high front end further comprises:

said high front end being approximately one and one half inches (1½") tall.

6. The wakeboard traction pad of claim 5, wherein said high front end further comprises:

said high front end being approximately nine and one-half inches (9½") wide.

7. The wakeboard traction pad of claim 1, wherein said low back end further comprises:

said low back end being approximately one fourth inch (¼") tall.

8. The wakeboard traction pad of claim 7, wherein said low back end further comprises:

said low back end being approximately eleven and one fourth inches (11¼") wide.

9. The wakeboard traction pad of claim 8, wherein the traction pad further comprises:

said first width of said high front end being shorter than said second width of said low back end; and sides of said traction pad tapering inward as travel is made from said low back end to said high front end; whereby the traction pad is wider at said low back end and presents a greater area upon which the rider may engage the traction pad.

10. The wakeboard traction pad of claim 1, wherein the traction pad further comprises:

a kicktail, said kicktail adjacent said high front end.

11. The wakeboard traction pad of claim 10, wherein said kicktail further comprises:

said kicktail present along said first width of said high front end; whereby the rider may engage said kicktail along any point of said top surface adjacent said high front end.

12. The wakeboard traction pad of claim 11, wherein said kicktail further comprises:

a dramatically increased slope adjacent said high front end, said dramatically increased slope mediating said high front end with a portion of said top surface adjacent said low back end having a significantly lesser slope.

13. The wakeboard traction pad of claim 12, wherein said kicktail further comprises:

said kicktail occupying approximately one-fourth to one-fifth of said top surface; and said significantly lesser slope portion occupying approximately three-fourths to four-fifths of said top surface.

14. The wakeboard traction pad of claim 1, wherein the traction pad further comprises:

an arch support.

15. The wakeboard traction pad of claim 14, wherein said arch support further comprises:

a ridge, said ridge travelling from approximately central to said high front end to approximately central to said low back end, said ridge centrally travelling along said top surface; whereby an arch present in the rider's foot may be engaged by said ridge to provide more contact surface area between the rider's foot and the traction pad for greater traction and sure-footedness.

16. The wakeboard traction pad of claim 1, wherein the traction pad further comprises:

said top surface defining first and second concave depressions;

said first concave depression on a left side of said top surface and said second concave depression on a right side of said top surface; and said first and second concave depressions accommodating a ball and a heel of the rider's foot when the rider's foot is set across the traction pad; whereby the rider's foot may be better engaged by said top surface to provide more contact surface area between the rider's foot and the traction pad for greater traction and sure-footedness.

17. The wakeboard traction pad of claim 1, wherein said low back end further comprises:

said low back end being tapered at each side of said low back end; whereby said low back end has a central tapered point that protrudes slightly away from the traction pad.

18. The wakeboard traction pad of claim 1, wherein the traction pad further comprises:

the traction pad being constructed of lightweight, water-resistant, and slightly compressible material; whereby the traction pad does not weigh down the wakeboard and the traction pad cushions the rider's foot.

19. A wakeboard traction pad for providing sure-footed engagement of a wakeboard by a rider thereof, comprising:

a top surface for engagement by the rider's feet, said top surface having a roughened surface, said roughened surface providing additional traction to the rider upon the wakeboard, said top surface having water-channelling means in the form of grooves defined by the traction pad widthwise across said top surface for channelling water away from the rider's foot so that water from an adjacent aqueous environment may be channelled away from the traction pad to better preserve sure footing for the rider and so that water upon said top surface may drain from said top surface by travelling outwardly from the traction pad;

a high front end having a first height of approximately one and one half inches (1½") and a first width of approximately nine and one-half inches (9½");

a low back end coupled to said high front end, said low back end having a second height of approximately one fourth inch (¼") and a second width of approximately eleven and one fourth inches (11¼"), said low back end being laterally tapered at each side of said low back end so that said low back end has a central tapered point that protrudes slightly away from the traction pad;

said top surface sloping or tapering to mediate said taller first height and said shorter second height and sides of said traction pad tapering inwardly as travel is made from said low back end to said high front end so that the traction pad is wider at said low back end and presents a greater area upon which the rider may engage the traction pad a kicktail, said kicktail adjacent said high front end present along said first width of said high front end so that the rider may engage said kicktail along any point of said top surface adjacent said high front end, said kicktail having a dramatically increased slope adjacent said high front end, said dramatically increased slope mediating said high front end with a portion of said top surface adjacent said low back end having a significantly lesser slope, said kicktail occupying approximately one-fourth to one-fifth of said top surface and said significantly lesser slope portion occupying approximately three-fourths to four-fifths of said top surface;

an arch support in the form of a ridge, said ridge travelling from approximately central to said high front end to approximately central to said low back end, said ridge centrally travelling along said top surface so that an arch present in the rider's foot may be engaged by said ridge to provide more contact surface area between the rider's foot and the traction pad for greater traction and sure-footedness said top surface defining first and second concave depressions, said first concave depression on a left side of said top surface with respect to said arch support and said second concave depression on a right side of said top surface with respect to said arch support, said first and second concave depressions accommodating a ball and a heel of the rider's foot when the rider's foot is set across the traction pad so that the rider's foot may be better engaged by said top surface to provide more contact surface area between the rider's foot and the traction pad for greater traction and sure-footedness; and the traction pad being constructed of lightweight, water-resistant, and slightly compressible material so that the traction pad does not weigh down the wakeboard and so that the traction pad cushions the rider's foot; whereby the wakeboard traction pad provides a sloping surface from said front and to said low back end to provide an angled traction surface and to provide the rider traction upon the wakeboard while riding the wakeboard.

20. A wakeboard incorporating the wakeboard traction pad of claim 1.

21. A wakeboard traction surface for a wakeboard, comprising:

a sloping surface, said sloping surface defined between a high front end and a low back end to provide an angled traction surface and to provide the rider traction upon the wakeboard while riding the wakeboard, said high front end terminating in a kicktail; and an arch support, said arch support defined upon said sloping surface; whereby greater control and traction are delivered to a rider of the wakeboard incorporating the wakeboard traction surface.

22. A wakeboard incorporating the traction pad of claim 21.

* * * * *